US010722005B1

(12) United States Patent
DiPietro

(10) Patent No.: US 10,722,005 B1
(45) Date of Patent: Jul. 28, 2020

(54) JEWELRY CLASP

(71) Applicant: Jason DiPietro, East Providence, RI (US)

(72) Inventor: Jason DiPietro, East Providence, RI (US)

( * ) Notice: Subject to any disclaimer, the term of this patent is extended or adjusted under 35 U.S.C. 154(b) by 84 days.

(21) Appl. No.: 15/958,060

(22) Filed: Apr. 20, 2018

Related U.S. Application Data

(60) Provisional application No. 62/490,121, filed on Apr. 26, 2017.

(51) Int. Cl.
*A44C 5/20* (2006.01)

(52) U.S. Cl.
CPC ..... *A44C 5/2057* (2013.01); *A44D 2203/00* (2013.01)

(58) Field of Classification Search
CPC ..... A44C 5/2057; A44C 5/2076; A44C 5/208; A44D 2203/00; Y10T 24/32
See application file for complete search history.

(56) References Cited

U.S. PATENT DOCUMENTS 2,623,256 A * 12/1952 Feibelman ..... A44C 5/2076 24/303
5,311,647 A * 5/1994 Levy ..... A44C 5/2042 24/303
7,181,939 B2 * 2/2007 Andersen ..... A45C 11/32 70/395
D704,085 S 5/2014 DiPietro
D704,086 S 5/2014 DiPietro
D704,087 S 5/2014 DiPietro
D704,588 S 5/2014 DiPietro
D707,582 S 6/2014 DiPietro
8,769,986 B1 7/2014 DiPietro
D712,299 S 9/2014 DiPietro
8,904,821 B1 12/2014 DiPietro
D741,740 S 10/2015 DiPietro
9,572,407 B2 * 2/2017 Ng ..... A44C 5/2066
2002/0083737 A1 * 7/2002 Esposito, Jr. ..... A44C 5/208 63/3.1
2004/0154143 A1 * 8/2004 Harrell ..... A44C 5/2076 24/303
2008/0047111 A1 * 2/2008 Garber ..... A44C 5/2061 24/303
2011/0030174 A1 * 2/2011 Fiedler ..... A45C 13/1069 24/303

* cited by examiner

*Primary Examiner* — Robert Sandy
*Assistant Examiner* — Rowland Do
(74) *Attorney, Agent, or Firm* — Salter & Michaelson

(57) ABSTRACT

A jewelry clasp that includes separate end pieces and a center housing that is adapted to engage and release with the separate end pieces. Each of the end pieces supports a magnet and further includes a blind passageway having the magnet disposed at a base of the blind passageway. The blind passageway further includes an annular slot, and the center housing includes a push button arrangement enabling engagement and release of the clasp. A pair of arms is supported from opposed sides of the center housing and the center housing further includes a pair of end flanges that are selectively engageable with the slot in the respective end pieces.

19 Claims, 15 Drawing Sheets

JEWELRY CLASP

RELATED CASES

Priority for this application is hereby claimed under 35 U.S.C. § 119(e) to commonly owned and U.S. Provisional Patent Application No. 62/490,121 which was filed on Apr. 26, 2017 and which is incorporated by reference herein in its entirety.

FIELD OF THE INVENTION

The present invention relates in general to a jewelry clasp and pertains, more particular to an improved clasp that can be used with a bracelet, bangle or necklace and that provides for a ready engagement and release

BACKGROUND OF THE INVENTION

There are a variety of different jewelry clasps that are known. However, for many of these jewelry clasp designs there is a difficulty in providing a quick and effective engagement of the clasp.

Accordingly, it is an object of the present invention to provide an improved jewelry clasp that provides an effective engagement and release.

Another object of the present invention is to provide a jewelry clasp that is particularly adapted for use with a bracelet, bangle or necklace structure.

Still another object of the present invention is to provide an improved jewelry clasp that is characterized by ready engagement and release and incorporates magnetic properties for engaging the clasp.

A further object of the present invention is to provide an improved jewelry clasp that incorporates a charm and in which the charm is replaceable or exchangeable with other charms.

Still a further object of the present invention is to provide an improved jewelry clasp used with a bracelet or the like having end pieces and a center locking mechanism.

SUMMARY OF THE INVENTION

To accomplish the foregoing and other objects, features and advantages of the present invention there is provided a there is provided a jewelry clasp for use with a jewelry band and that is comprised of separate end pieces that are adapted to be intercoupled with a center housing. Each of the end pieces supports a magnet and further includes a passageway with an annular slot. The center housing includes a push button arrangement enabling engagement and release of the clasp. A pair of arms is supported from opposed sides of the housing and the housing furthermore supports a leg arrangement with an end flange engageable with the slot in the end piece. Each arm also supports a magnet so that when the clasp is in a closed position the end piece and arm magnets are in engagement.

In accordance with one embodiment of the present invention there is provided a jewelry clasp comprising: separate end pieces; a center housing that is adapted to engage and release with the separate end pieces; each of the end pieces supporting a magnet and further including a blind passageway having the magnet disposed at a base of the blind passageway; said blind passageway further including an annular slot; said center housing including a push button arrangement enabling engagement and release of the clasp, and a pair of arms that are supported from opposed sides of the center housing; and said center housing further including a pair of end flanges that are selectively engageable with the slot in the respective end pieces.

In accordance with other aspects of the present invention each arm also supports a magnet so that when the clasp is in a closed position the end piece magnet and the arm magnet are in engagement; the center housing also includes a pair of legs disposed about the respective arms; the pair of legs have the respective end flanges; each arm has an enlarged distal end for supporting the arm magnet; the enlarged distal end of each arm defines a recess into which the leg fits; the push button is comprised of a pair of oppositely disposed push buttons that are separated by a spring member that biases the push buttons away from each other to lock each end flange into a corresponding end piece slot; and each of the end flanges is magnetized to provide an attractive force with the respective end piece magnets.

In accordance with another embodiment of the present invention there is provided a jewelry clasp comprising: at least one end piece; and a center housing that is adapted to engage and release with the at least one end piece; the at least one end pieces supporting a magnet and further including a blind passageway having the magnet disposed at a base of the blind passageway; said blind passageway further including an annular slot; said center housing including a push button arrangement enabling engagement and release of the clasp, and an arm that is supported from the center housing; and said center housing further including a leg that is supported by said arm and has an end flange that is selectively engageable with the slot in the at least one end piece.

In accordance with still other aspects of the present invention the arm also supports a magnet so that when the clasp is in a closed position the end piece magnet and the arm magnet are in engagement; the arm has an enlarged distal end for supporting the arm magnet; the enlarged distal end of the arm defines a recess into which the leg fits; the push button is comprised of a pair of oppositely disposed push buttons that are separated by a spring member that biases the push buttons away from each other to lock the end flange into the corresponding end piece slot; and the end flange is magnetized to provide an attractive force with the respective end piece magnet.

In accordance with still another embodiment of the present invention there is provided a jewelry clasp comprising: separate end pieces; and a center housing that is adapted to engage and release with the separate end pieces; each of the end pieces supporting a magnet and further including a passageway having the magnet disposed at a base of the passageway; said passageway further including an annular channel; and said center housing having oppositely directed annular pieces that each include oppositely disposed tabs constructed and arranged to rotationally engage with the annular channel in opening and closing the clasp.

In accordance with further aspects of the present invention each of the annular pieces of the center housing supports a magnet so that when the clasp is in a closed position the end piece magnets engage with center housing magnets; the end pieces are each provided with a front slot that is adapted to receive the oppositely disposed tabs therethrough; the annular piece also has a second set of oppositely disposed tabs that are offset from the first set of tabs by 90 degrees; each end piece has spaced apart channels, one channel for receiving the first set of tabs and the second channel for receiving the second set of tabs; and further including a stop in either of the channels for limiting relative rotation between the center housing and separate end pieces.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 8:
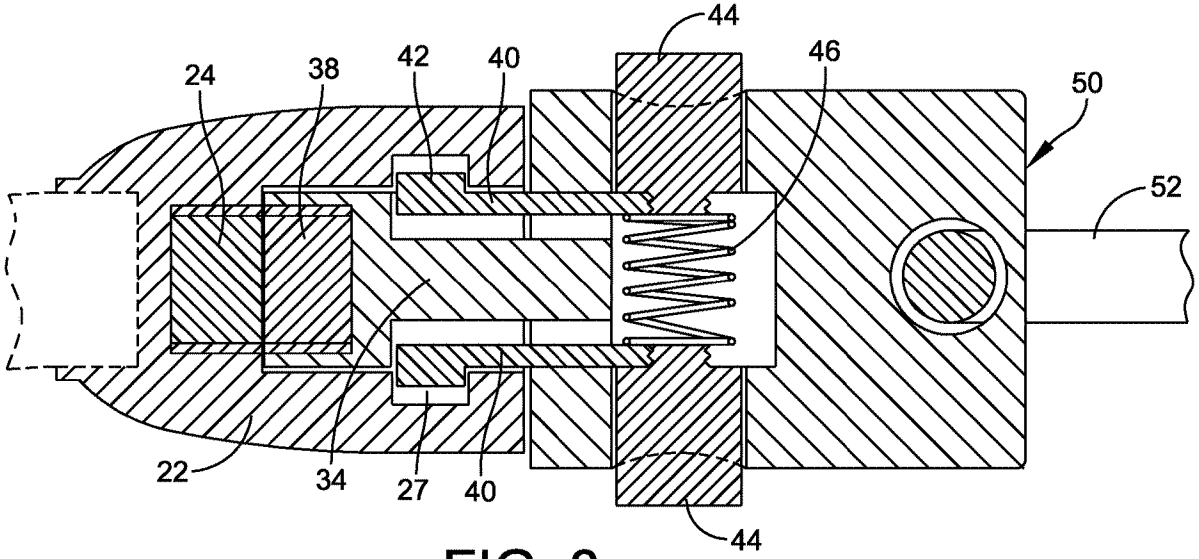
FIG. 8 is a cross-sectional view of another embodiment of the present invention including a single arm arrangement.
Figure 9:
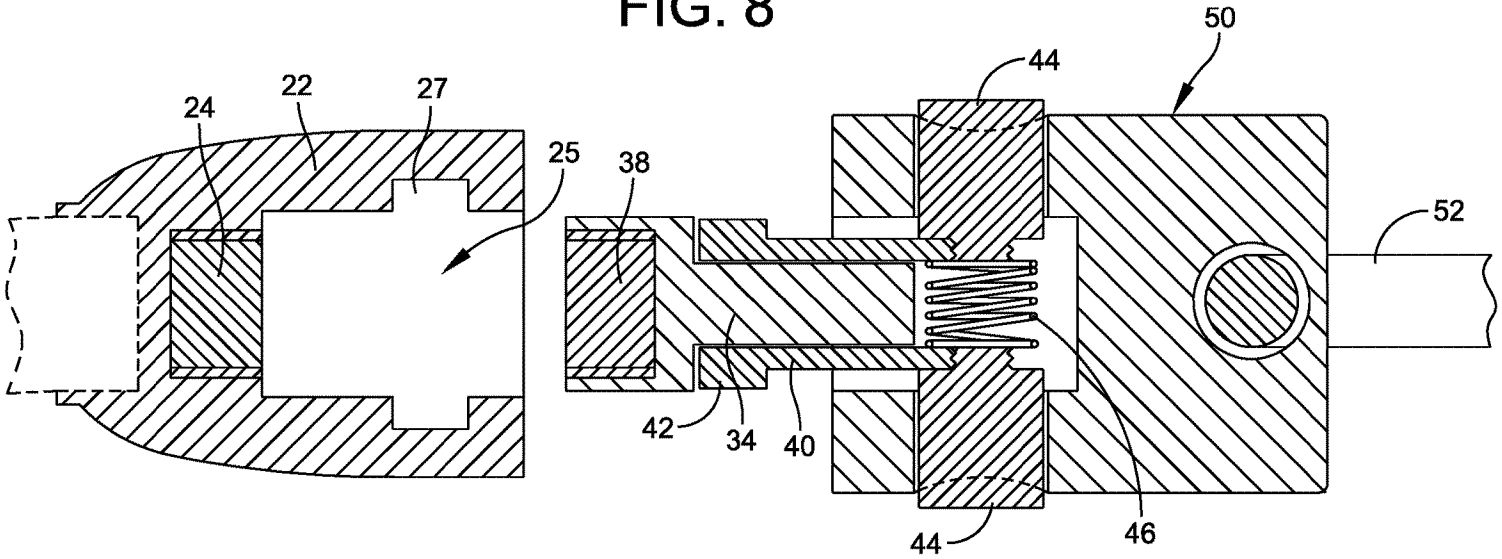
FIG. 9 is a cross-sectional view showing the buttons being depressed for release of the end piece.
Figure 10:
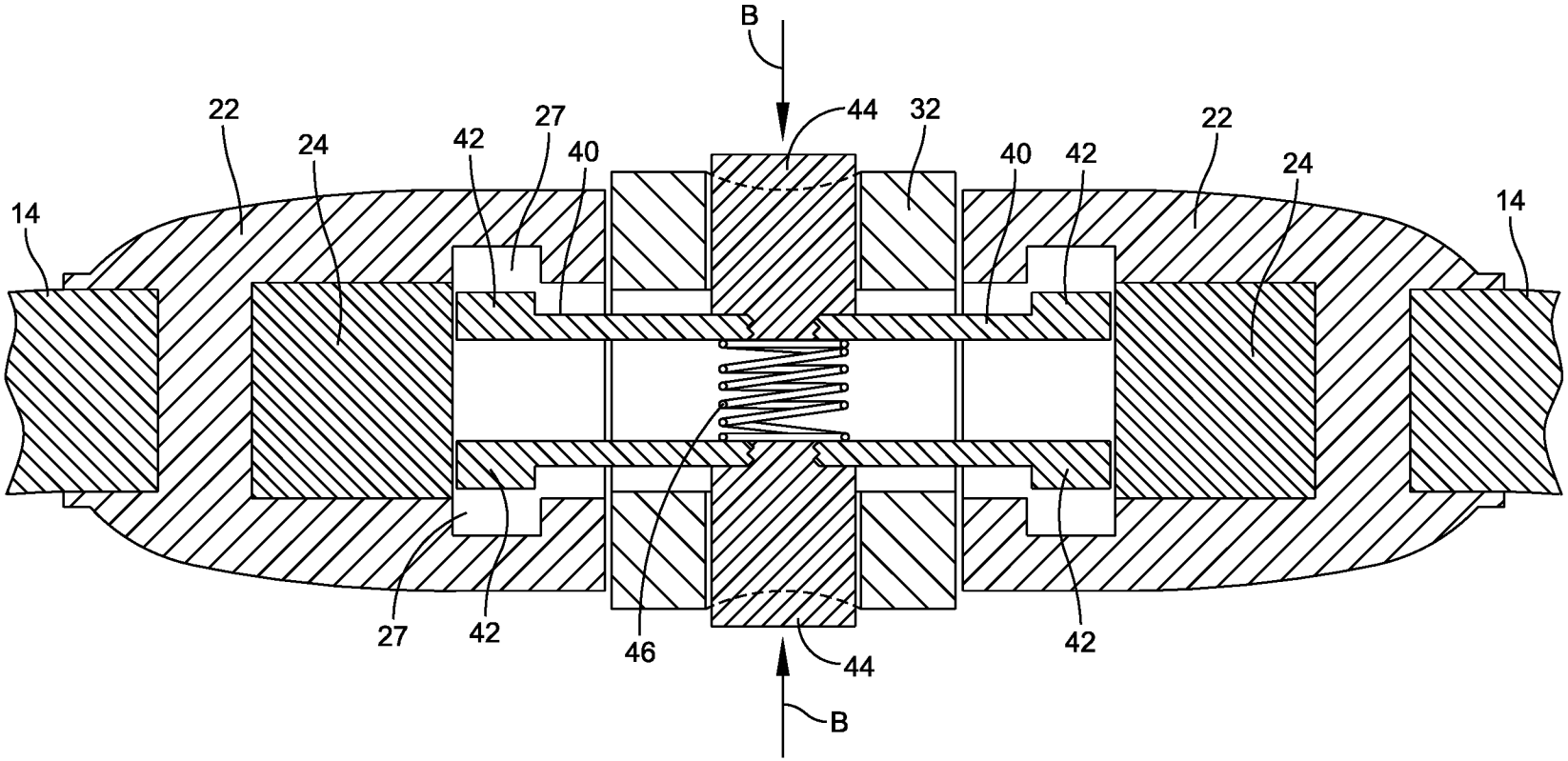
FIG. 10 is a cross-sectional view of the third embodiment of the present invention.
Figure 11:
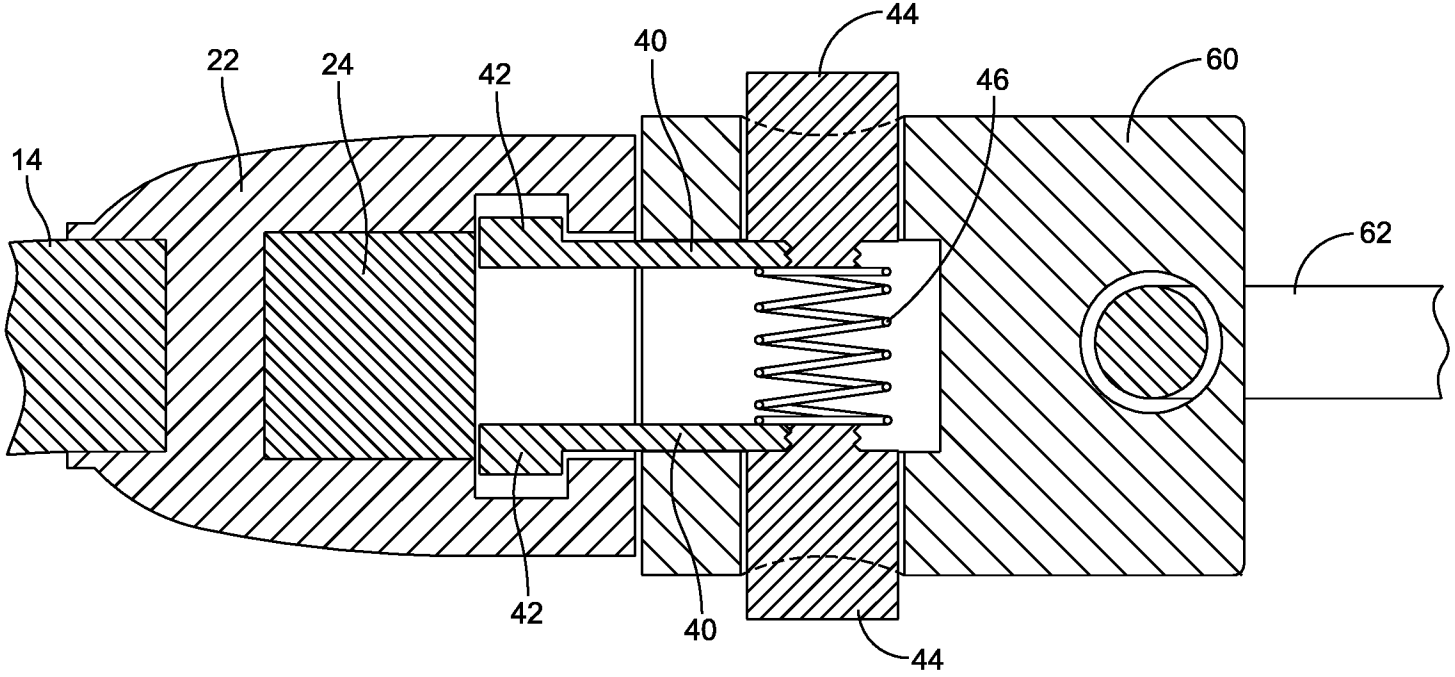
FIG. 11 is still another embodiment of the present invention employing a single end piece.

Reference is now made to the drawings for an illustration of a number of different embodiments of the jewelry clasp in accordance with the present invention. A first embodiment is illustrated in FIGS. 1-7 in which a pair of end pieces are employed. A second embodiment is illustrated in FIGS. 8 and 9 where only a single end piece is associated with an end housing. A further embodiment of the present invention is illustrated in FIG. 10 including a pair of end pieces. Still a further embodiment of the present invention is illustrated in FIG. 11 in which a single end piece is used with an attaching housing.

Figure 1:
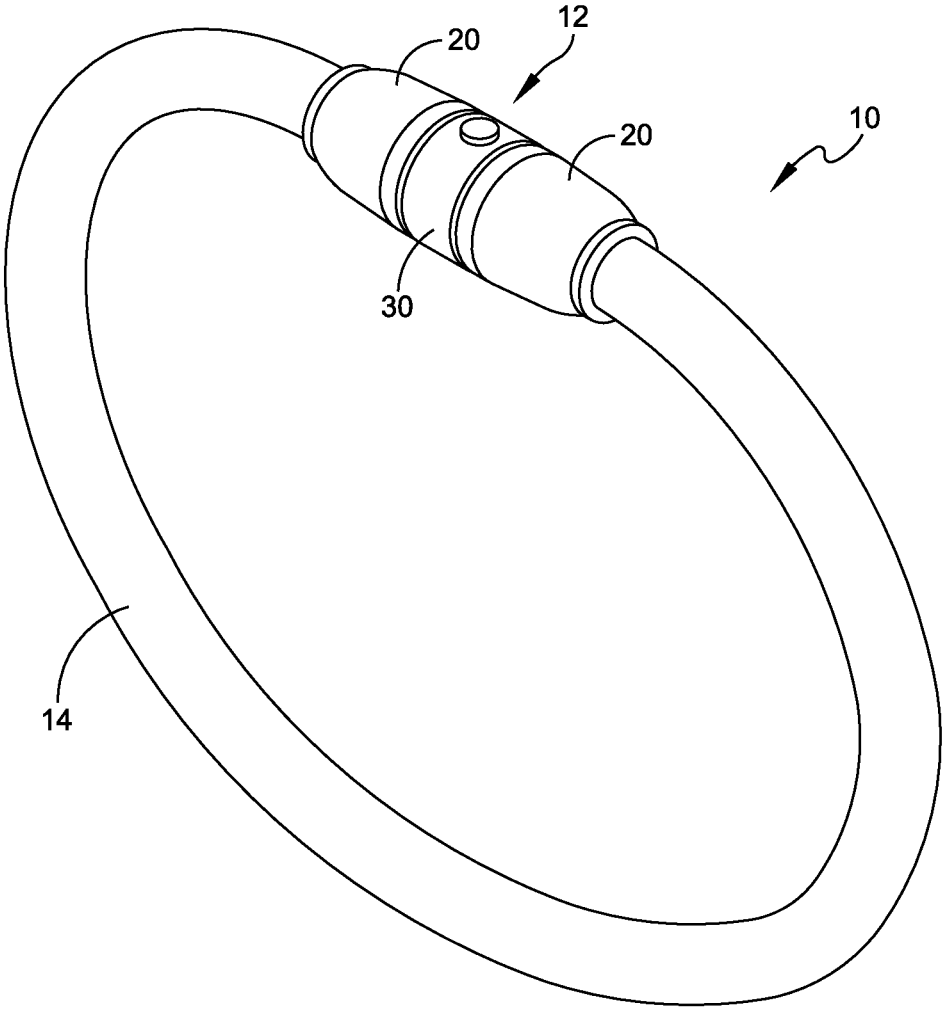
FIG. 1 is a perspective view of one embodiment of the jewelry clasp of the present invention.
Figure 2:
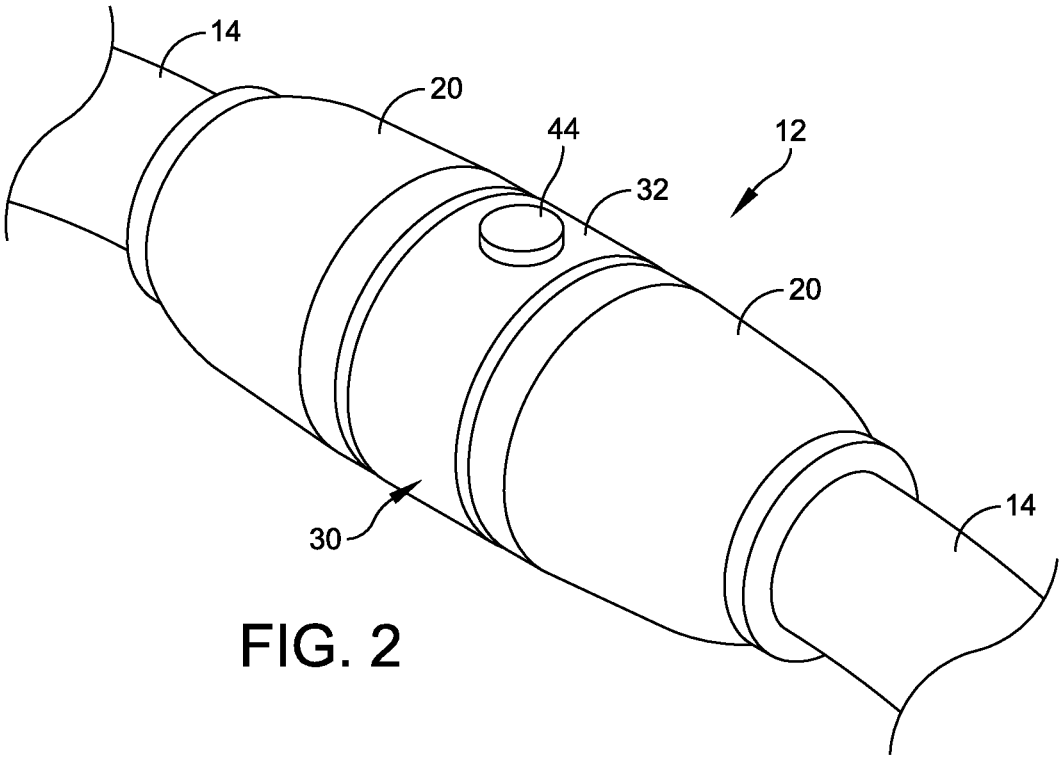
FIG. 2 is an enlarged fragmentary perspective view at the area of clasp.
Figure 3:
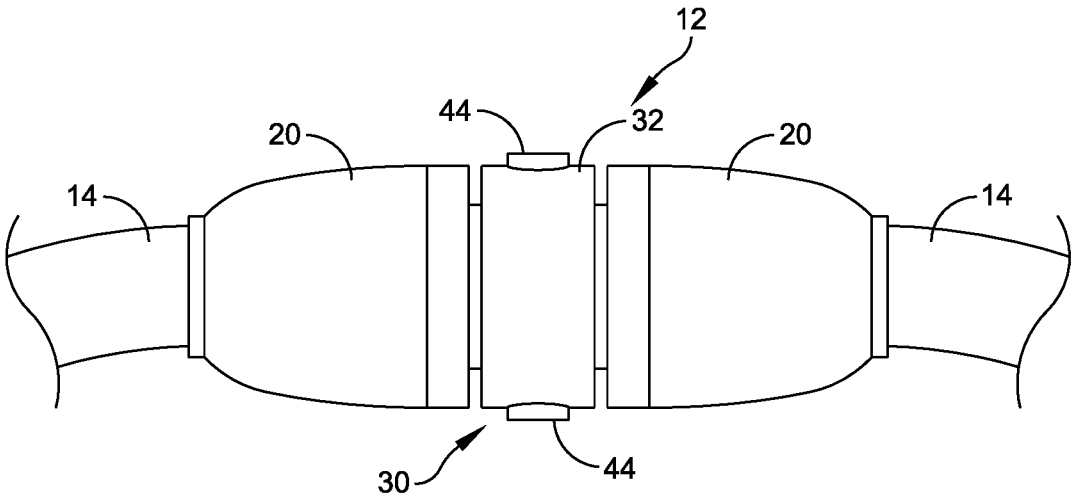
FIG. 3 is a side elevation view of the clasp illustrated in FIG. 2.
Figure 4:
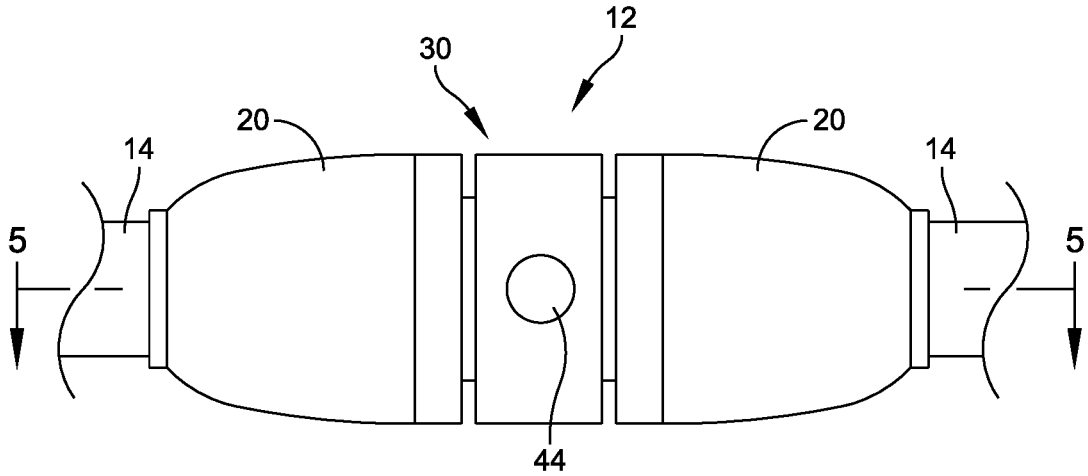
FIG. 4 is a plan view of the clasp shown in FIGS. 1-3.
Figure 5:
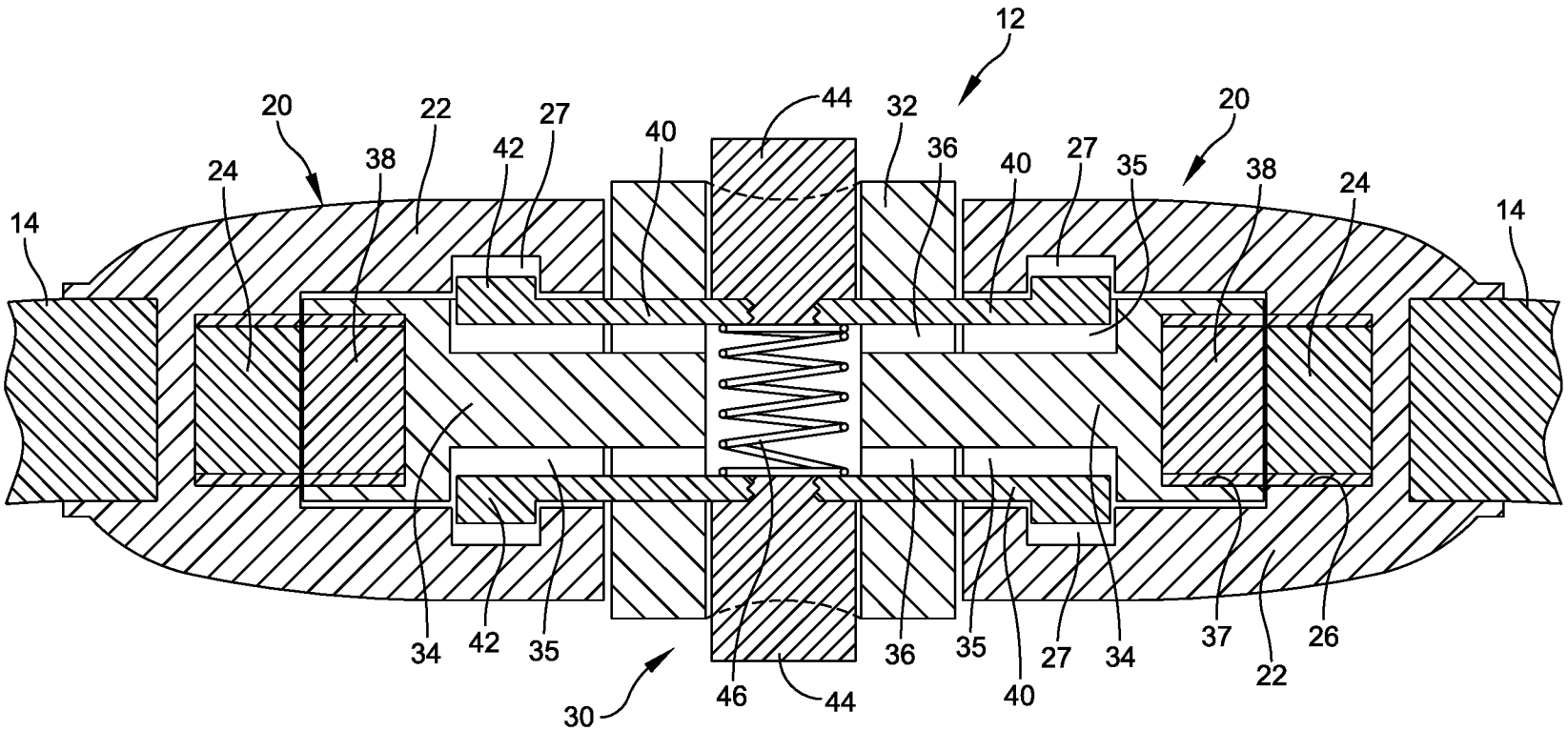
FIG. 5 is a cross-sectional view taken along line 5-5 of FIG. 4 with the clasp in a closed or locked position.

The first embodiment illustrated in FIGS. 1-7 disclose as a jewelry item 10 that includes the clasp 12 of the present invention. FIG. 1 also illustrates a band 14 or the like that can take on many different forms and that is attached at its ends to ends of the clasp 12. More particularly, this band 14, as illustrated in FIGS. 4 and 5, is attached to respective end pieces at 20. Each end piece illustrated in the first embodiment may be substantially identical in construction and is shown as capturing an end of the band 14. The end piece 20 is comprised of a main housing 22 having a center passage at 25 that includes, part way down the passage 25 an annular slot 27 that will be instrumental in locking the end piece housing with the center housing. The passage 25 also has an end slot 26 for receiving a magnet at 24.

Figure 6:
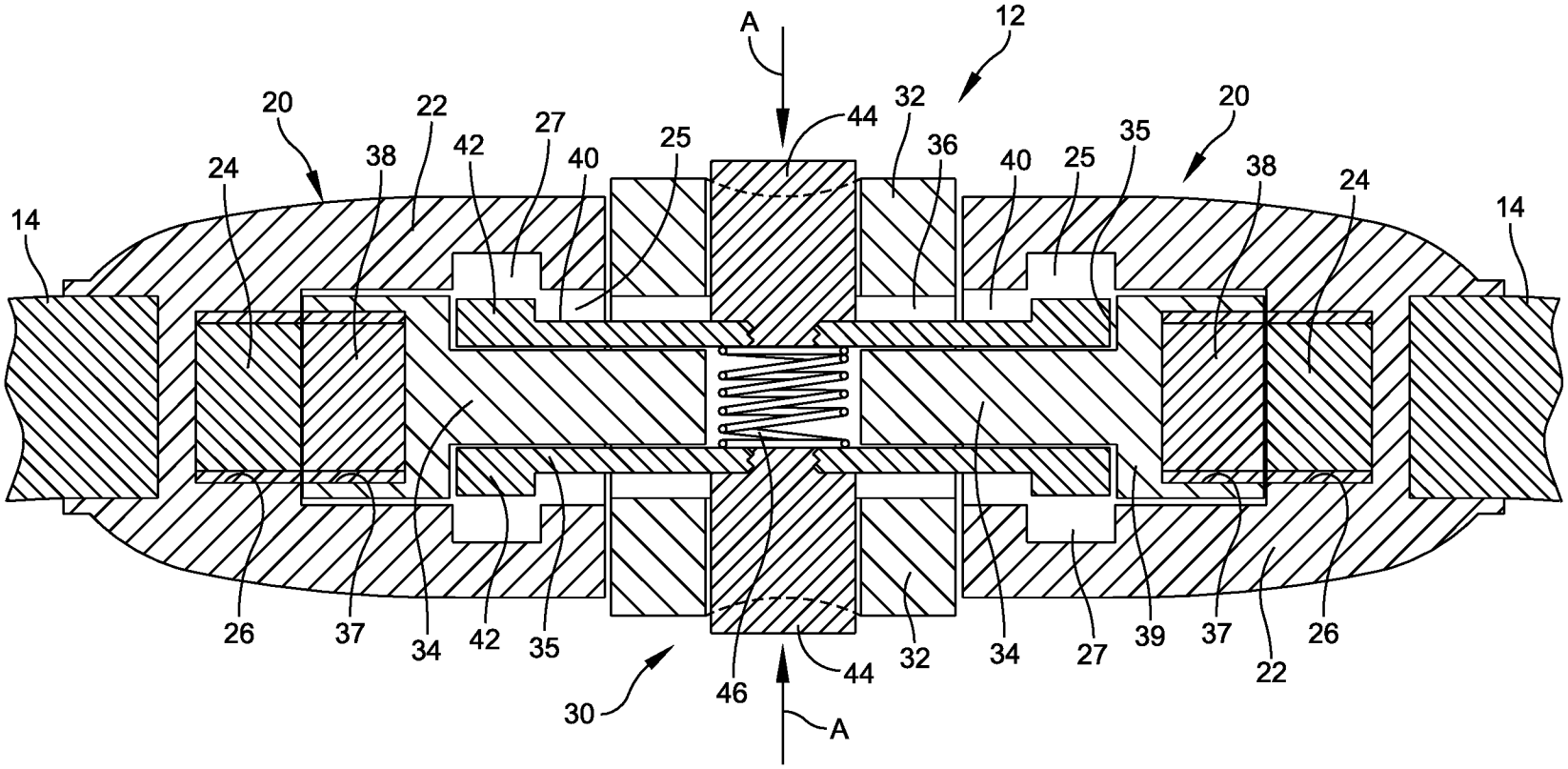
FIG. 6 is a cross-sectional view similar to that illustrated in FIG. 5 with the buttons being depressed so as to open the clasp.
Figure 7:
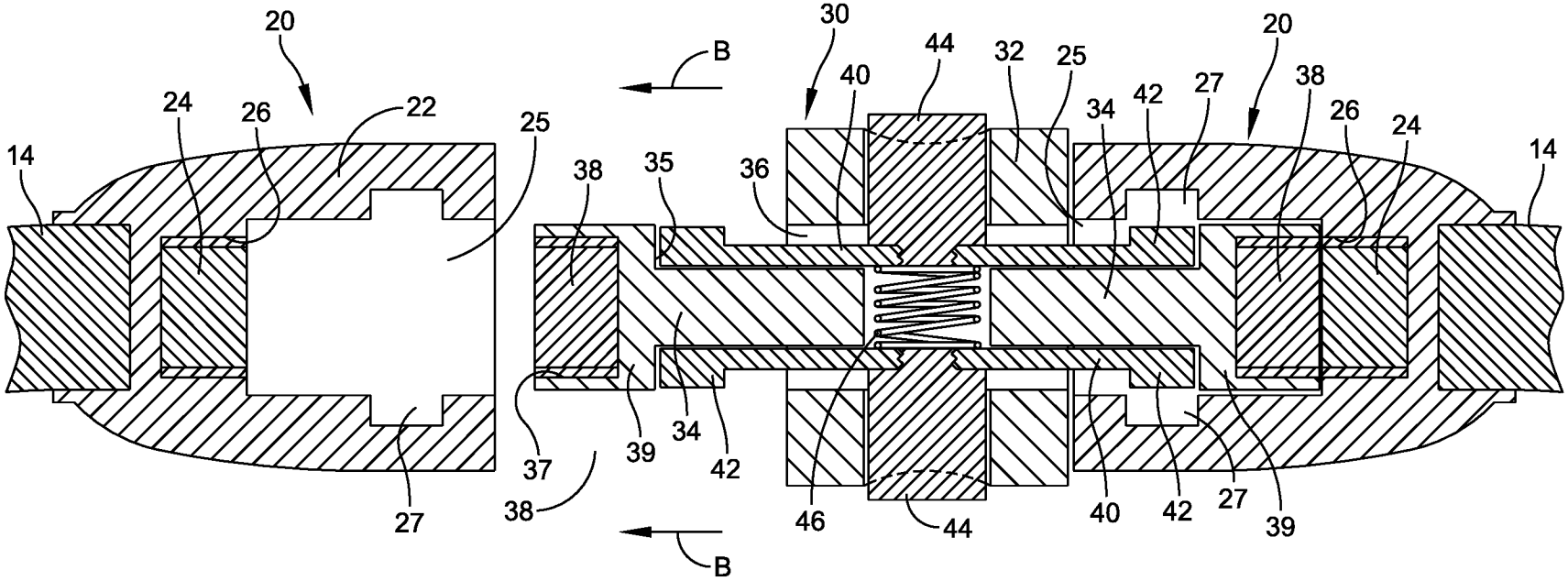
FIG. 7 is a cross-sectional view similar to that illustrated in FIGS. 5 and 6 but showing one of the end pieces disengaged from the center housing.

The center housing 32 is illustrated in FIGS. 5-7 as for supporting opposed end buttons 44 which are normally biased apart by the spring 46. The housing 32 also supports opposed direction arms 34 that each have an enlarged end 39. This end 39 has an open recess 37 for receiving the magnet 38. The magnets 24 and 38 would be polarized so as to provide an attractive force therebetween. Each of the arms 34 also has a recess 35 into which the elongated legs 40 extend. The end of each of the legs 40 is formed as an enlarged flange 42 that is adapted for positioning within the slot 27 of the housing 22 when the clasp is in a locked position such as illustrated in FIG. 5. Each of the arms 34 is secured with the housing 32 and extend in opposite directions. FIG. 5 illustrates a magnet 38 at each end of the respective arms 34.

As indicated previously, the cross-sectional view of FIG. 5 shows the clasp in a locked position wherein the flange 42 of each of the legs 40 extend into the annular slot 27. The cross-sectional view of FIG. 6 shows the buttons 44 pressed inward as in the direction of arrows A in FIG. 6. This action shifts the legs 40 downward against the arms 34. This action is against the bias of the spring 46 and furthermore moves the flanges 42 out of the slot 27. The cross-sectional view of FIG. 7 illustrates one of the housing 22 being released from the housing 32. Thus, the magnets 24 and 38 are disengaged. Although not illustrated in FIG. 7, the other end piece 20 may also be released in a similar manner.

Reference is now made to FIGS. 8 and 9 for another embodiment of the present invention. In this embodiment the same reference numbers are used as previously described in FIGS. 1-7. Instead of the housing 32 illustrated in the first embodiment, there is a housing 50 for supporting the buttons 44. FIGS. 8 and 9 also illustrate the magnets 24 and 38 as well as the arm 34 and the leg 40. In the position of FIG. 8, the flange 42 of the leg 40 is shown disposed within the slot 27 locking the end piece 20 with the housing 50. The housing 50 may also include a link 52 so that the member can be corrected with another component. This would be in a manner similar to that described in my earlier U.S. Pat. No. 8,904,821, particularly in FIG. 11 illustrating the use of links for supporting a charm or the like as well as a bracelet band. U.S. Pat. No. 8,904,821 is hereby incorporated by reference herein in its entirety.

Reference is now made to the cross-sectional view of FIG. 10. This embodiment also uses the legs 40, buttons 44, and biasing spring 46. This is contained within a center housing 32. The opposed magnets are shown at 24. In this particular embodiment the legs 40 may also be formed as magnetic members so as to provide the desired attractive forces. The embodiment of FIG. 10 also illustrates the housing slot 27 and the end flanges 42 that can be used for engaging and disengaging with the slot 27. In the cross-sectional view of FIG. 10, the buttons as shown pressed in the direction of arrow B are so that the legs 40 disengage with the slot 27.

Another embodiment of the present invention is illustrated in FIG. 11 wherein, rather than two separate end pieces, there is provided a single end piece 22 and a housing 60 that may also include a link 62. This embodiment also illustrates the buttons 44, the spring 46 and legs 40 that extend in only a single direction toward the end piece 22. FIG. 11 illustrates the clasp in a locked position wherein the end flange 42 of each of the legs 40 is locked within the slot 27 of the housing 22.

Figure 12:
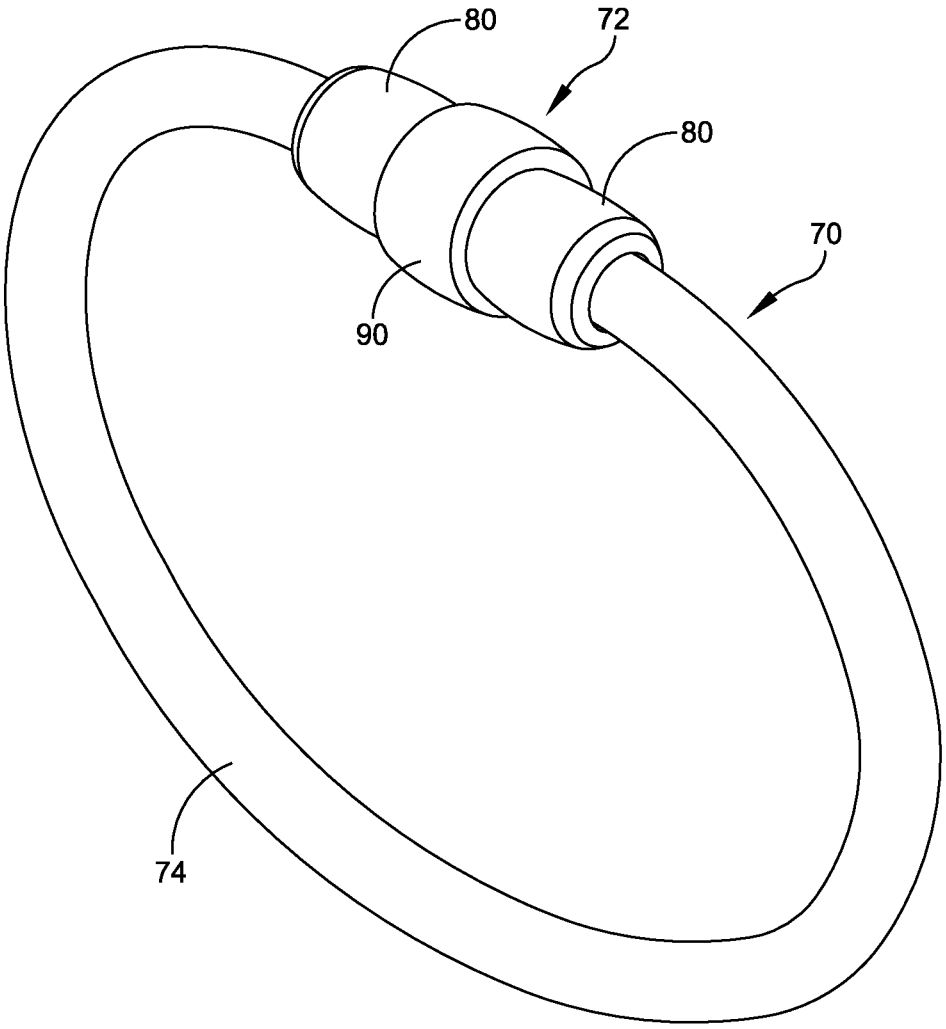
FIG. 12 is a perspective view of a further embodiment of the present invention.
Figure 13:
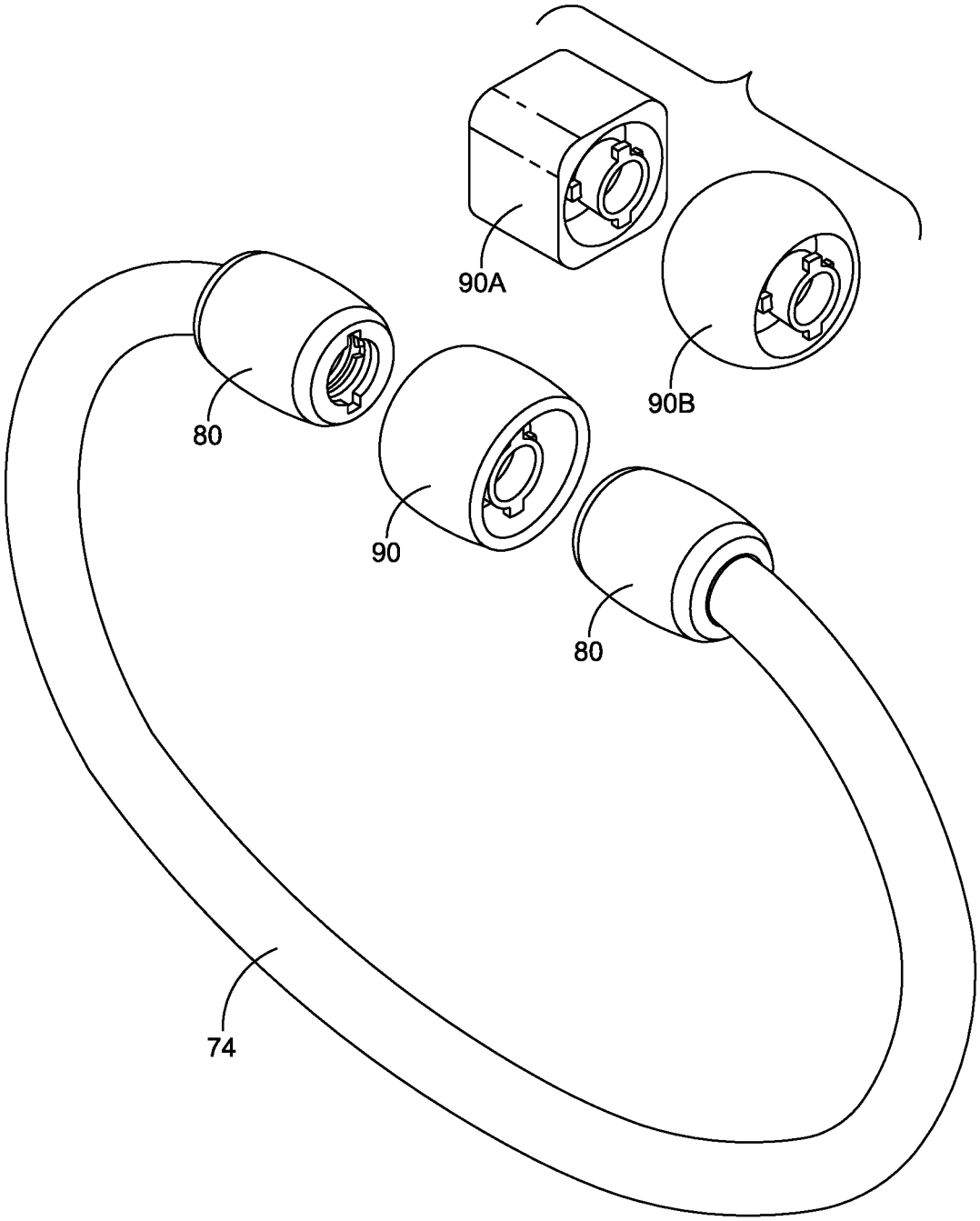
FIG. 13 is a perspective view showing the embodiment of FIG. 12 with the center piece separated from the respective end pieces.
Figure 14:
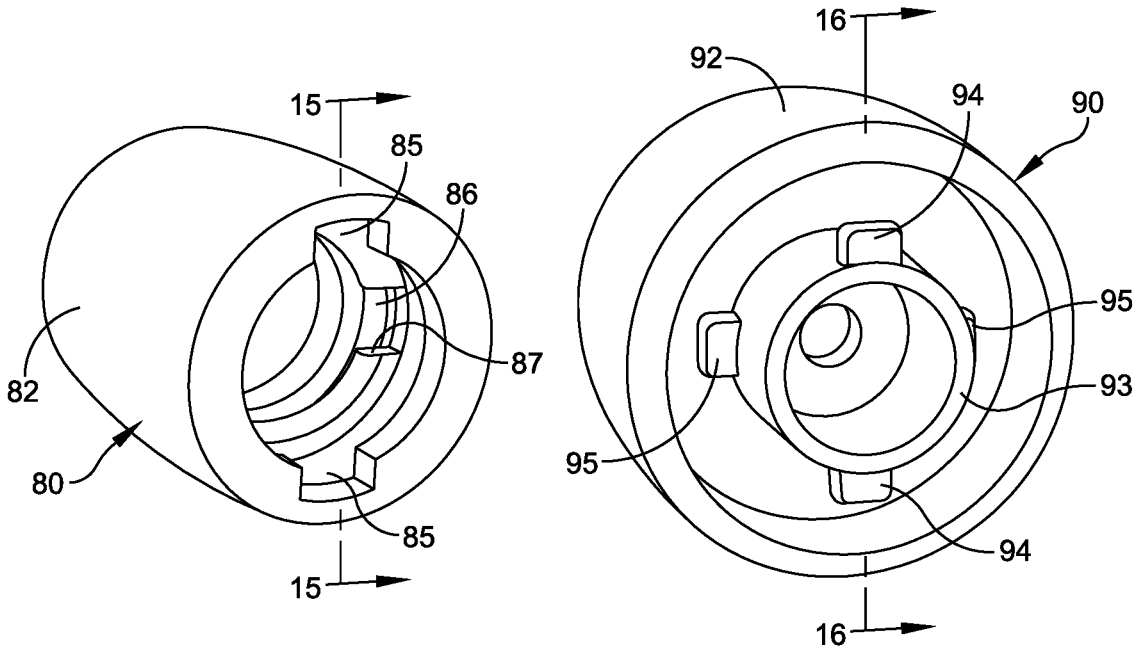
FIG. 14 is a perspective view illustrating a respective end piece and a respective center piece formed as a charm.
Figure 15:
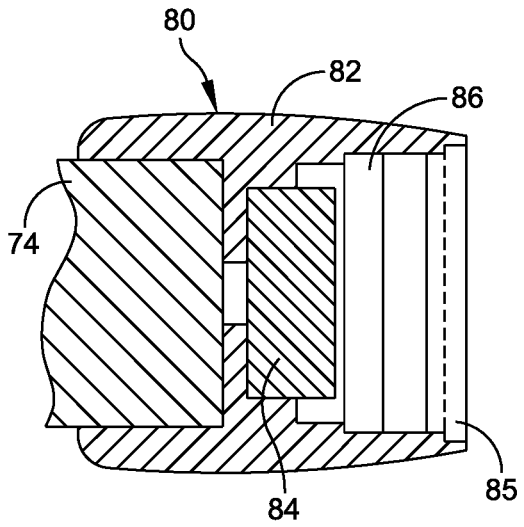
FIG. 15 is a cross-sectional view taken along line 15-15 of FIG. 14.
Figure 16:
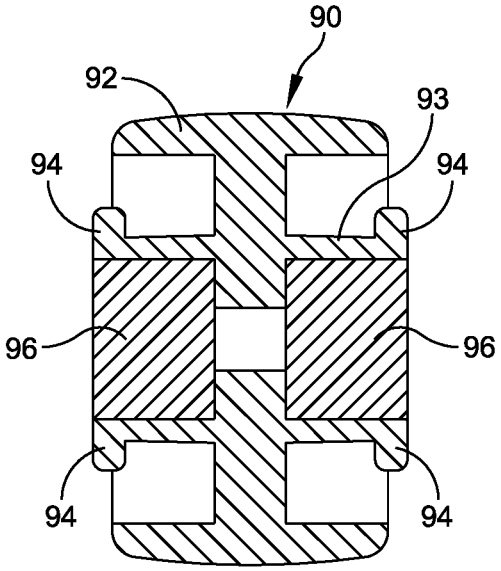
FIG. 16 is a cross-sectional view taken along line 16-16 of FIG. 14.
Figure 17:
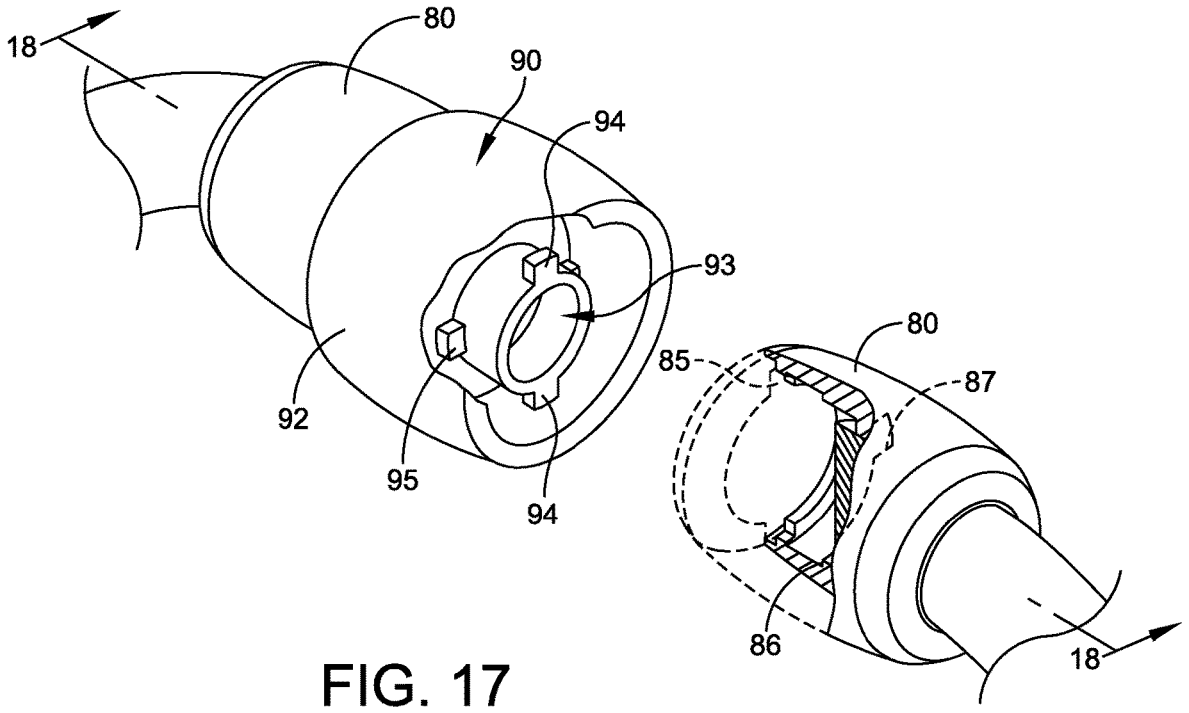
FIG. 17 is a partial perspective view showing the interlocking of the center piece with one of the end pieces.
Figure 18:
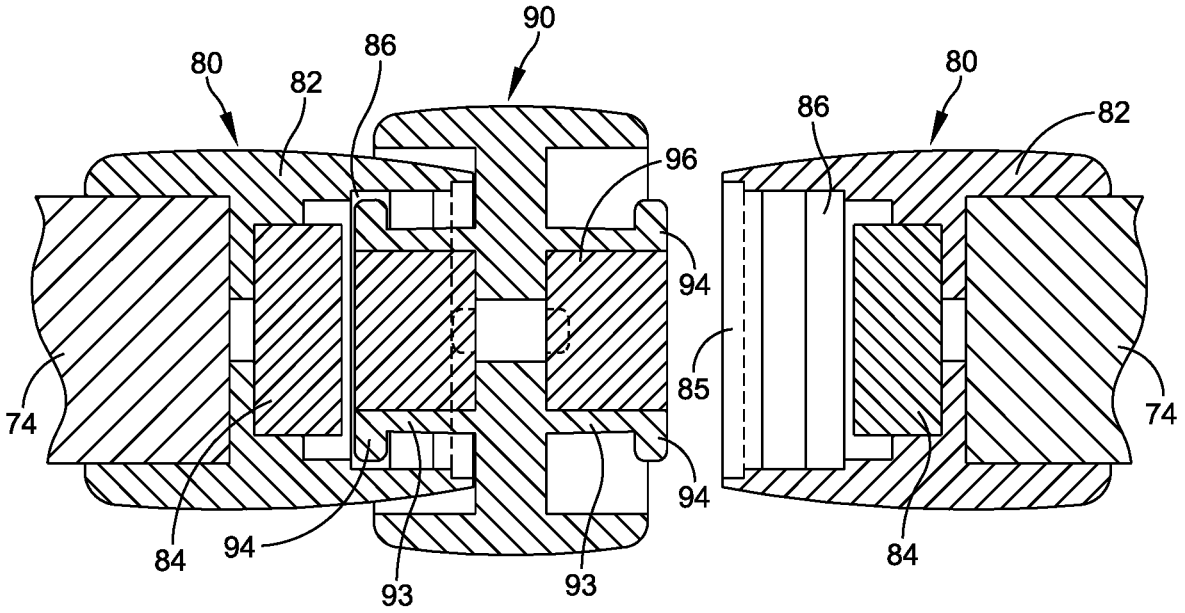
FIG. 18 is a cross-sectional view taken along line 18-18 of FIG. 17 with one of the end pieces shown exploded away.
Figure 19:
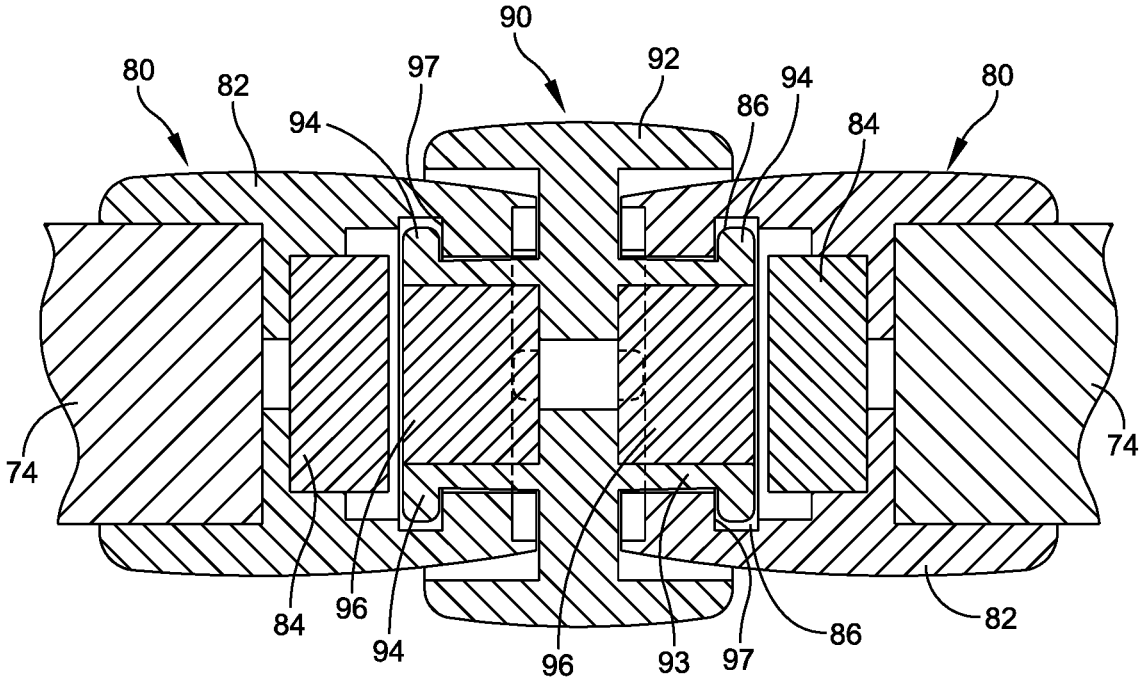
FIG. 19 is a cross-sectional view similar to that shown in FIG. 18 with the center piece in its locked position.
Figure 20:
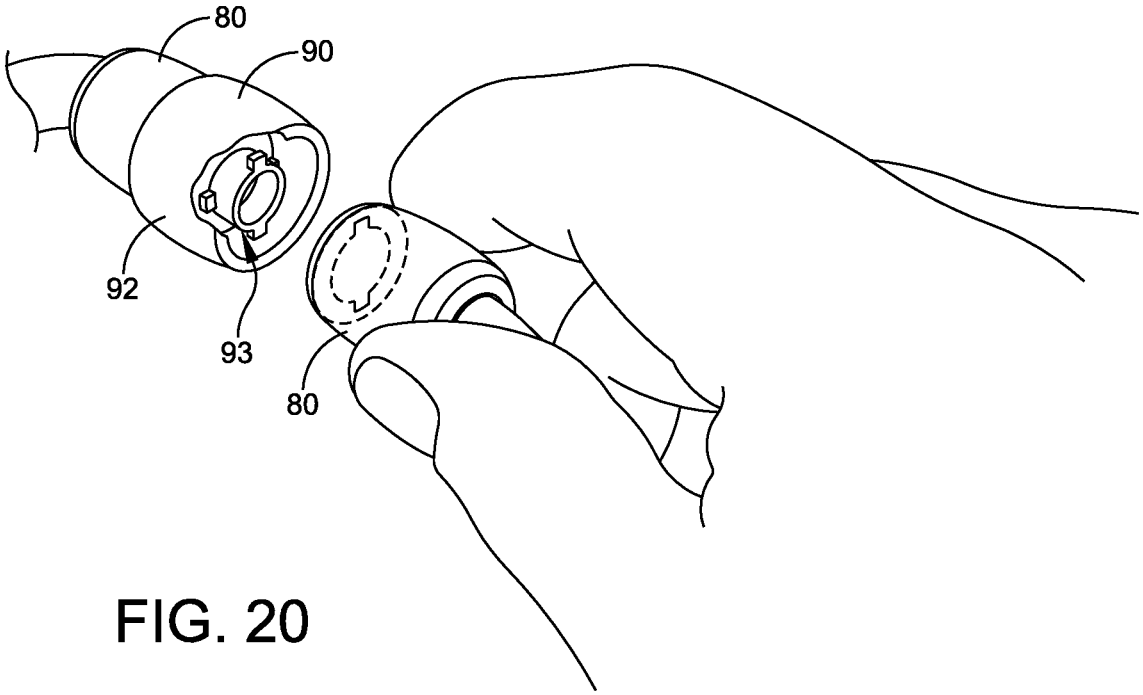
FIG. 20 is a fragmentary perspective view showing one of the end pieces being engaged with the center piece with there being a magnetic attraction.
Figure 21:
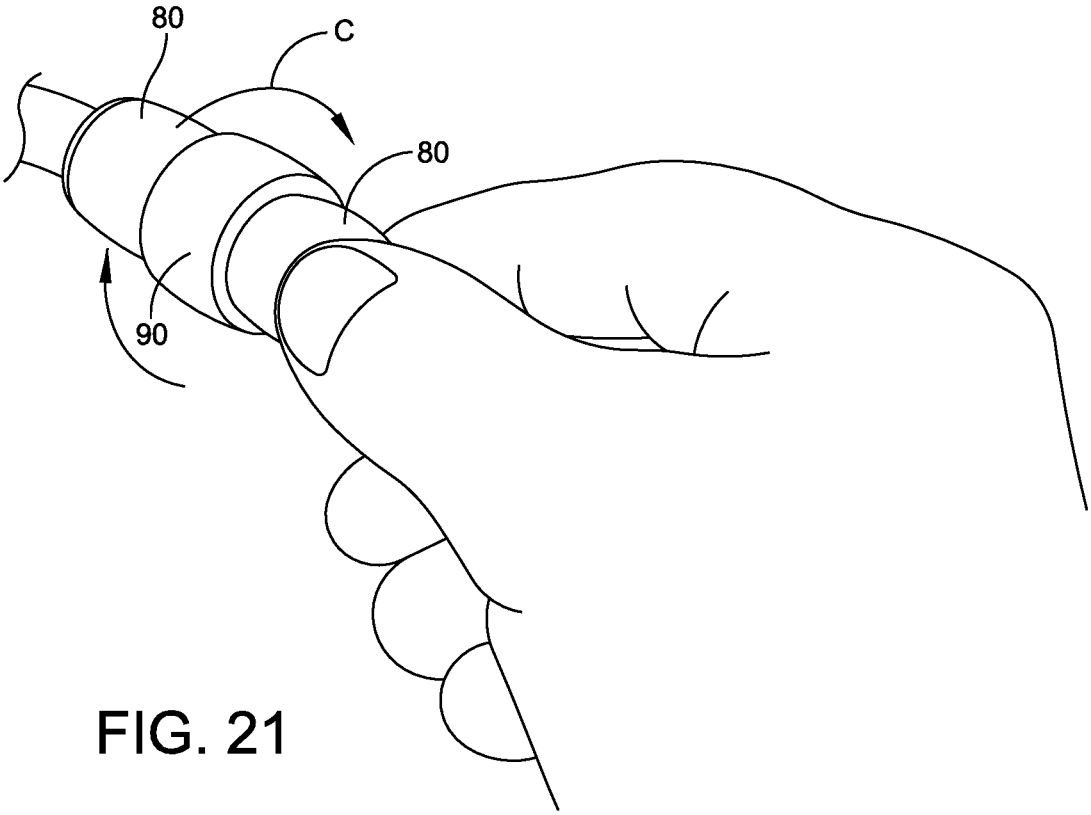
FIG. 21 illustrates the rotation of the center piece locking the center piece with both opposed end pieces.

A further embodiment of the present invention is illustrated in FIGS. 12-21 in which a center piece 90 is in the form of a "charm". This center piece 90 can take on a multitude of different configurations and includes opposed end male pieces that are to engage with respective female pieces of the end pieces 80. In this embodiment FIG. 12 is a perspective view of a further embodiment of the present invention. FIG. 13 is a perspective view showing the embodiment of FIG. 12 with the center piece separated from the respective end pieces. FIG. 14 is a perspective view illustrating a respective end piece and a respective center piece formed as a charm. FIG. 15 is a cross-sectional view taken along line 15-15 of FIG. 14. FIG. 16 is a cross-sectional view taken along line 16-16 of FIG. 14. FIG. 17 is a partial perspective view showing the interlocking of the center piece with one of the end pieces. FIG. 18 is a cross-sectional view taken along line 18-18 of FIG. 17 with one of the end pieces shown exploded away. FIG. 19 is a cross-sectional view similar to that shown in FIG. 18 with the center piece in its locked position. FIG. 20 is a fragmentary perspective view showing one of the end pieces being engaged with the center piece with there being a magnetic attraction. FIG. 21 illustrates the rotation of the center piece locking the center piece with both opposed end pieces.

In the embodiment of FIGS. 12-21 there is disposed a jewelry item 70 that includes the clasp/charm structure of the present invention indicated at 72 in FIG. 12. The drawings also illustrate a band 74 or the like that can take on many different forms and that is attached at its ends to the end of the clasp 72. This attachment may be by several different means. More particularly, this band 74, as illustrated in FIGS. 18 and 19 is attached to respective end pieces 80. Each of the end pieces illustrated in this embodiment may be substantially identical in construction with each of these end pieces preferably permanently attached to an end of the band 74.

The perspective view of FIG. 12 illustrates the bracelet in its interlocked position. The perspective view of FIG. 13 illustrates the components exploded away from each other. FIG. 13 also illustrates alternate center pieces 90A and 90B which may respectively be in the form of different configuration charms. Thus, this particular bracelet although it has six configuration end pieces 80, it is constructed so that the center charm can be readily removed and interchanged. FIG. 15 is a cross-sectional view illustrating the construction of one of the end pieces 80. FIG. 15 also illustrates the end of the band 14. The end piece 80 is comprised of a housing 82 that supports the magnet 84. As illustrated in FIG. 14 the housing 82 is provided with a front slot 85 that is adapted to receive a male end of the center piece 90. FIG. 15 also illustrates the channel 86 in which the male piece can rotate. Refer also to FIG. 14 to the stop at 87 that limits the rotation of the center piece relative to the end pieces.

FIG. 16 is a cross-sectional view illustrating further details of the center piece 90. This is comprised of a housing 92 that has oppositely directed annular pieces 93 that are in the form of a tubular member. Integrally formed at the end of each of these annular pieces 93 are oppositely extending tabs 94. It is noted in FIG. 14 that the piece 93 may also be provided with opposed tabs 95 that are set off 90 degrees from the tabs 94. These tabs 94 and 95 may be adapted for receipt in separate annular channels like the channel 86 depicted in FIG. 14. The cross-sectional view of FIG. 16 also illustrates respective magnets 96.

Reference is now made to the partial perspective view of FIG. 17 that shows the male member at 93 and the opposed tabs at 94. The tabs at 94 are meant to engage within the opposed slots 85. Once these various pieces are engaged, such as in the completed cross-sectional view of FIG. 19, the center piece 90 may be rotated, once the tabs 94 are engaged in a slot in the respective end pieces, so as to lock the position of the center piece 90 relative to the end pieces 80.

In the cross-sectional view of FIG. 18 one of the extended pieces is shown exploded away from the center piece 90. This illustrates the manner in which the center piece male member can engage within the female opening of the end piece 80. The tabs 94 extend within an annular channel 86 in the locked position such as shown on the left in FIG. 18. The rotation of the center piece 80 is limited by means of a stop that is illustrated in FIG. 14 at 87. In FIG. 19 it is noted that the magnets 84 and 96 provide an attractive force so that once the tabs 94 extend through the slot 85 the magnets cause a direct attraction so that tabs 94 are disposed in an annular channel within the respective end pieces. By then rotating the center piece 90, the various components are locked in position by virtue of the tab 94 being urged against a wall surface at 97 as depicted in FIG. 19.

In accordance with the method of operation of the embodiment of FIGS. 12-21, there is provided a relatively easy way of engaging the end pieces 80 with the center piece 90. This initial engagement is by virtue of the engagement of the center piece with the end pieces by way of the tabs 94 and slots 85. Once these components are placed sufficiently close to each other then there is a magnetic attraction between the magnets 84 and 96. Once in this position such as illustrated in the cross-sectional view of FIG. 18, then the center piece 90 is rotated preferably through 90 degrees engaging the wall 97 and essentially locking all pieces together. These motions are illustrated in FIGS. 20 and 21. Refer in particular in FIG. 21 to the rotational arrow C for an illustration of the rotation of the center piece to lock the center piece with the respective end pieces 80.

With further reference to FIGS. 14-21, it is noted that the annular piece 93 is provided with a first pair of opposed tabs 94 at the very end of the annular piece and a further pair of opposed tabs 95 that are preferably displaced 90 degrees from the tabs 94. When the pieces 80 and 90 are engaged such as illustrated in FIGS. 17 and 18, the opposed tabs 94 first pass through the slot 85. The magnets 84 of the end piece 80 provides an attractive force with the magnet 96 of the center piece 90 and thus there is a tendency for the two pieces 80 and 90 to slide towards each other. The tabs 94 then engage the annular channel 86 and are rotated 190 degrees. This rotation is illustrated in FIG. 21. In this way, the center piece 90 can be used to rotatably lock both end pieces in place virtually at the same time. When this rotation occurs, then the tabs 95 will be in alignment with the slots 85 and can fall into the slots 85 assuring that the magnets 84 and 96 come into firm engagement. The tabs 94 are limited as to their rotation by virtue of the presence of the stop at 87 that limits the relative rotation between the centerpiece and the end pieces.

Having now described a limited number of embodiments of the present invention, it should now be apparent to those skilled in the art that numerous other embodiments and modifications thereof are contemplated as falling within the scope of the present invention, as defined by the appended claims.

What is claimed is:

The invention claimed is:

1. A jewelry clasp comprising:

separate end pieces;

a center housing that is adapted to engage and release with the separate end pieces;

each of the end pieces supporting a magnet and further including a passageway having the magnet disposed at a base of the passageway;

said passageway further including an annular channel;

said center housing having oppositely directed annular pieces that each include oppositely disposed tabs constructed and arranged to rotationally engage with the annular channel in opening and closing the clasp; and a stop for limiting relative rotation between the center housing and separate end pieces.

2. The jewelry clasp of claim 1 wherein each of the annular pieces of the center housing supports a magnet so that when the clasp is in a closed position the end piece magnets are disposed in relative juxtaposition with center housing magnets.

3. The jewelry clasp of claim 2 wherein the end pieces are each provided with a front slot that is adapted to receive the oppositely disposed tabs therethrough.

4. The jewelry clasp of claim 3 wherein the annular piece also has a second set of oppositely disposed tabs that are offset from the first set of tabs by 90 degrees.

5. The jewelry clasp of claim 1 wherein the passageway also has a pair of oppositely disposed slots at an entry to the passageway, and the oppositely disposed tabs are initially engaged through the oppositely disposed slots.

6. A jewelry clasp comprising:

separate end pieces;

a center housing that is adapted to engage and release with the separate end pieces;

each of the end pieces supporting a magnet and further including a passageway having the magnet disposed at a base of the passageway;

said passageway further including an annular channel;

said center housing having oppositely directed annular pieces that each include oppositely disposed tabs constructed and arranged to rotationally engage with the annular channel in opening and closing the clasp;

wherein each of the annular pieces of the center housing supports a magnet so that when the clasp is in a closed position the end piece magnets are disposed in relative juxtaposition with center housing magnets;

wherein the end pieces are each provided with a front slot that is adapted to receive the oppositely disposed tabs therethrough;

wherein the annular piece also has a second set of oppositely disposed tabs that are offset from the first set of tabs by 90 degrees; and wherein each end piece has spaced apart channels, one channel for receiving the first set of tabs and the second channel for receiving the second set of tabs.

7. The jewelry clasp of claim 6 including a stop in either of the channels for limiting relative rotation between the center housing and separate end pieces.

8. A jewelry clasp comprising:

separate end pieces;

a center housing that is adapted to engage and release with the separate end pieces;

each of the end pieces supporting a magnet and further including a passageway having the magnet disposed at a base of the passageway;

said passageway further including an annular channel, wherein the passageway also has a pair of oppositely disposed slots at an entry to the passageway, and the oppositely disposed tabs are initially engaged through the oppositely disposed slots;

said center housing having oppositely directed annular pieces that each include oppositely disposed tabs constructed and arranged to rotationally engage with the annular channel in opening and closing the clasp; and a stop in the annular channel for limiting relative rotation between the center housing and separate end pieces.

9. A jewelry clasp comprising:

separate end pieces;

a center housing that is adapted to rotationally engage and release with the separate end pieces;

each of the end pieces supporting a magnet and further including a passageway having the magnet disposed at a base of the passageway;

each of the annular pieces of the center housing also supporting a magnet so that when the clasp is in a closed position the end piece magnets are disposed in relative juxtaposition with the center housing magnets;

said passageway further including an inner annular channel;

said center housing having oppositely directed annular pieces that each include at least one tab constructed and arranged to rotationally engage with the annular channel in opening and closing the clasp;

wherein each said end piece has a channel for receiving the at least one tab.

10. The jewelry clasp of claim 9 wherein the end pieces are each provided with at least one front slot that is adapted to receive the at least one tab.

11. The jewelry clasp of claim 10 wherein the end pieces are each provided with a pair of oppositely disposed front slots, and the oppositely directed annular pieces each include oppositely disposed tabs, the tabs for engagement with the slots.

12. A wherein the annular piece also has a second set of oppositely disposed tabs that are offset from the first set of tabs by 90 degrees.

13. The jewelry clasp of claim 9 including a stop in the inner annular channels for limiting relative rotation between the center housing and separate end pieces.

14. The jewelry clasp of claim 9 including a band for connecting the separate end pieces, and wherein each end piece has an opening for receiving respective ends of the band.

15. A jewelry clasp comprising:

separate end pieces;

a center housing that is adapted to rotationally engage and release with the separate end pieces;

each of the end pieces supporting a magnet and further including a passageway having the magnet disposed at a base of the passageway;

each of the annular pieces of the center housing also supporting a magnet so that when the clasp is in a closed position the end piece magnets are disposed in relative juxtaposition with the center housing magnets;

passageway further including an inner annular channel;

said center housing having oppositely directed annular pieces that each include at least one tab constructed and arranged to rotationally engage with the annular channel in opening and closing the clasp;

wherein the end pieces are each provided with at least one front slot that is adapted to receive the at least one tab;

wherein the end pieces are each provided with a pair of oppositely disposed front slots, and the oppositely directed annular pieces each include oppositely disposed tabs, the tabs for engagement with the slots;

wherein the annular piece also has a second set of oppositely disposed tabs that are offset from the first set of tabs by 90 degrees; and wherein each end piece has spaced apart annular channels, one annular channel for receiving the first set of tabs and the second annular channel for receiving the second set of tabs.

16. A jewelry clasp that is comprised of separate end pieces, a center housing that is adapted to rotationally engage and release with the separate end pieces and a band that connects the separate end pieces; each of the end pieces having a passageway; each said passageway further including an inner annular channel forming a female member; said center housing having oppositely directed annular pieces that each include at least one tab forming a male member; said male and female members constructed and arranged for rotationally relative engagement in opening and closing the clasp; wherein the annular piece also has a second set of oppositely disposed tabs that are offset from the first et of tabs, and wherein each end piece has spaced apart annular channels, one annular channel for receiving the first set of tabs and the second annular channel for receiving the second set of tabs.

17. The jewelry clasp of claim 16 wherein each of the end pieces supports a magnet that is disposed at a base of the passageway; each of the annular pieces of the center housing also supporting a magnet so that when the clasp is in a closed position the end piece magnets are disposed in relative juxtaposition with the center housing magnets.

18. The jewelry clasp of claim 16 wherein the end pieces are each provided with at least one front slot that is adapted to receive the at least one tab.

19. The jewelry clasp of claim 18, wherein the end pieces are each provided with a pair of oppositely disposed front slots, and the oppositely directed annular pieces each include oppositely disposed tabs, the tabs for engagement with the slots, and wherein the annular piece also has a second set of oppositely disposed tabs that are offset from the first set of tabs by 90 degrees.

* * * * *